US005499778A

United States Patent [19]

Hehner et al.

[11] Patent Number: 5,499,778

[45] Date of Patent: Mar. 19, 1996

[54] SOUND-DAMPENED PAPER-WINDING MACHINE

[75] Inventors: Reinhard Hehner, Haan; Georg Müller, Neuss, both of Germany

[73] Assignee: Jagenberg Aktiengesellschaft, Dusseldorf, Germany

[21] Appl. No.: 148,849

[22] Filed: Nov. 8, 1993

[30] Foreign Application Priority Data

Nov. 7, 1992 [DE] Germany ..... 42 37 673.4

[51] Int. Cl.[6] ..... B65H 18/14

[52] U.S. Cl. ..... 242/541

[58] Field of Search ..... 242/530, 530.4, 242/539; 160/265, 271, 273.1

[56] References Cited

U.S. PATENT DOCUMENTS

| | | | |
|---|---|---|---|
| 507,288 | 10/1893 | Schroeder | 160/271 |
| 1,131,924 | 3/1915 | Gervais | 160/271 |
| 3,157,371 | 11/1964 | Billingsley | 242/530 |
| 3,222,004 | 12/1965 | Crowe | 242/530.4 |
| 3,792,820 | 2/1974 | Lucas | 242/530.4 |
| 3,792,824 | 2/1974 | Meyer et al. | 242/530 |
| 4,083,395 | 4/1978 | Romano | 160/84 |
| 4,175,608 | 11/1979 | Alten | 160/273.1 |
| 5,131,450 | 7/1992 | Lichy | 160/273.1 |
| 5,308,006 | 5/1994 | Hehner | 242/530 |

FOREIGN PATENT DOCUMENTS 3618955 12/1987 Germany .

*Primary Examiner*—Daniel P. Stodola
*Assistant Examiner*—Emmanuel M. Marcelo
*Attorney, Agent, or Firm*—Herbert Dubno; Andrew Wilford

[57] ABSTRACT

A paper-winding machine having a frame and supports for paper rolls carried by the frame and forming winding stations has a pair of overhead windup rollers supported on the members and flanking the rolls, and respective sound-absorbing curtains of flexible sheet material on the windup rollers and movable from positions hanging down therefrom and absorbing sound generated at the stations and positions wound up on the respective rollers.

5 Claims, 1 Drawing Sheet

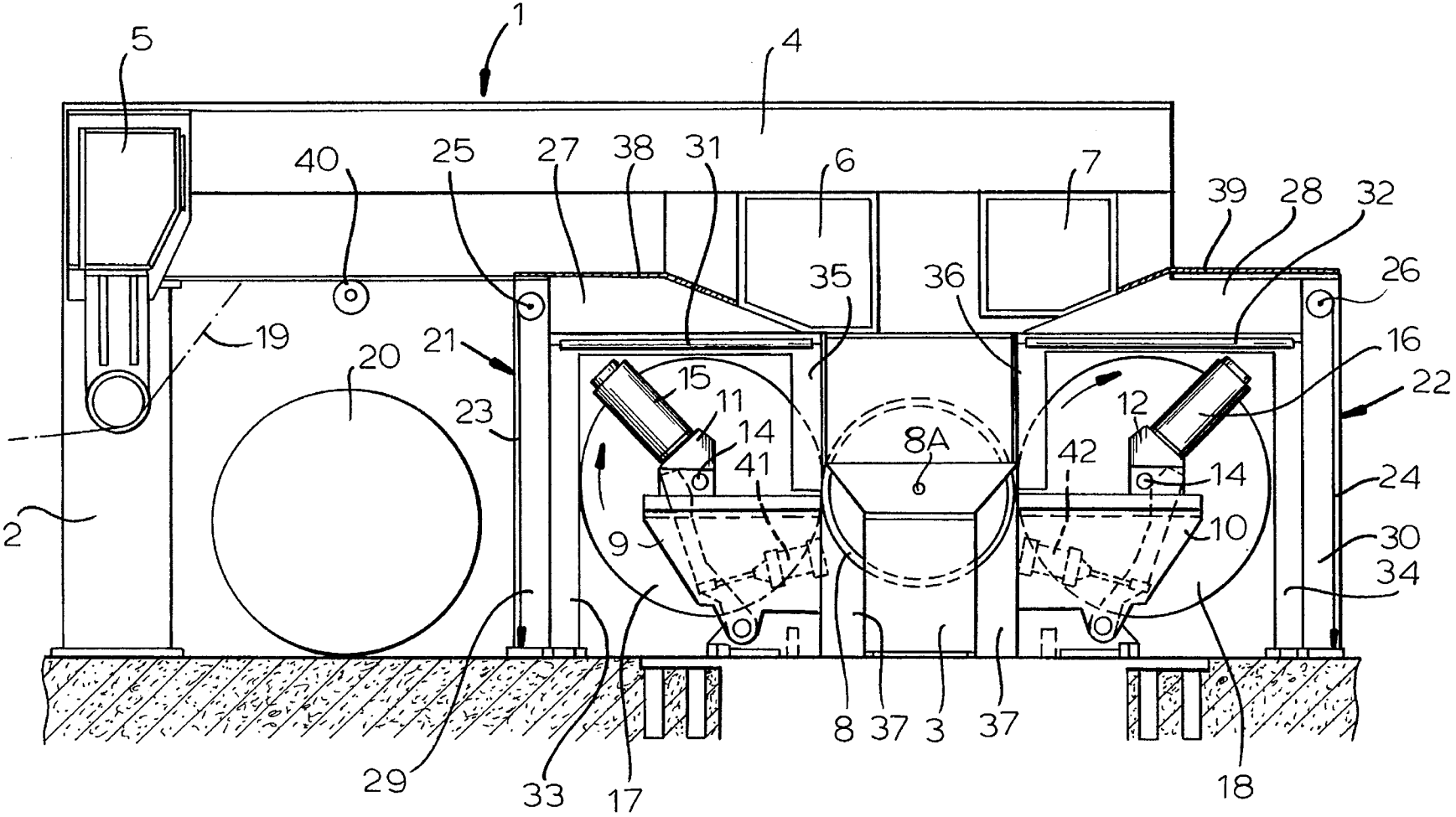
1
2
3
4
5
6
7
8
8A
9
10
11
12
14
15
16
17
18
19
20
21
22
23
24
25
26
27
28
29
30
31
32
33
34
35
36
37
38
39
40
41
42

SOUND-DAMPENED PAPER-WINDING MACHINE

FIELD OF THE INVENTION

The present invention relates to a machine that winds up paper products. More particularly this invention concerns a machine that forms large rolls of paper, cardboard, and the like.

BACKGROUND OF THE INVENTION

In the production of newsprint and similar paper products it is standard to start with a very large and very long roll of the paper, to unroll it and simultaneously slit it into a plurality of strips, and to wind these strips up on different cores rotated about two different centers. This is described in detail in application Ser. No. 07/778,873 filed Dec. 23, 1991, now U.S. Pat. No. 5,405,099, and in German patent document 3,618,955 filed Jun. 5, 1986 by H. Hofferberth.

This subdividing/winding procedure therefore entails the use of heavy equipment moving at high speed. As a result the system generates a large amount of noise that is irritating and even possibly unhealthy for the persons working on and around the equipment.

OBJECTS OF THE INVENTION

It is therefore an object of the present invention to provide an improved paper-winding machine that operates more quietly than the prior-art machines.

Another object is to provide such a sound-dampened paper-winding machine which is as easy to service and use as the noisier prior-art machines.

SUMMARY OF THE INVENTION

A paper-winding machine having a frame and support members for paper rolls carried by the frame and forming winding stations according to the invention has a pair of overhead wind-up rollers supported on the members and flanking the rolls, and respective sound-absorbing curtains of flexible sheet material on the wind-up rollers and movable from positions hanging down therefrom and absorbing sound generated at the stations and positions wound up on the respective rollers.

Thus with this system these curtains can be dropped to absorb the sound generated at the stations and thereby greatly reduce the noise produced by the equipment. These curtains at the same time in no way interfere with operation of the machine. They are spaced from the respective rolls by a distance smaller than the maximum roll diameter so that, while absorbing much of the noise generated, they do not get in the way of the operators of the machine.

According to the invention at least one second pair of overhead wind-up rollers separate from the first-mentioned pair is provided that is arranged generally perpendicular thereto and flanking the rolls. Respective second sound-absorbing curtains of flexible sheet material on the second windup rollers are movable from positions hanging down therefrom and absorbing sound generated at the stations and positions wound up on the respective rollers.

The curtains are each formed according to the invention of at least one transparent synthetic-resin foil and are each at least 4 mm thick. Normally each curtain is formed of at least two such foils substantially less than 4 mm thick so the curtain remains flexible.

The apparatus of this invention has upright edge guides receiving edges of the curtains in the hanging-down position. Sound-absorbing shields supported on the frame above the stations further dampen noise generated by the paper-winding machine. The paper is pulled from overhead down into the machine between the curtains and shields to the main roller.

In accordance with this invention the rolls each have a predetermined horizontal length and vertical height. The curtains having a predetermined width greater than the length and the wind-up rollers are spaced above the ground by a distance greater than the height. Thus the rolls can be moved into and out of the stations easily when the respective curtains are open.

BRIEF DESCRIPTION OF THE DRAWING

The above and other objects, features, and advantages will become more readily apparent from the following description, reference being made to the accompanying drawing whose sole Figure is a partly diagrammatic view of a sound-dampened paper-winding apparatus according to the invention.

SPECIFIC DESCRIPTION

As seen in the drawing a machine frame 1 is comprised basically of uprights 2 and 3, horizontal longitudinal beams 4 (only one shown) bridging them, and horizontal transverse beams 5, 6, and 7 transversely bridging the longitudinal beams 4. A main support roller 8 rotatable about a transversely extending horizontal axis 8A is centered beneath the transverse beams 6 and 7 and is flanked by a pair of winder supports 9 and 10. In turn these winder supports 9 and 10 carry on their upper surfaces slides 11 and 12 movable radially of the roller 8 by actuators 41 and 42 and carrying heads 14 rotatable about respective transversely extending horizontal axes by respective drives 15 and 16 to support respective take-up cores or rolls 17 and 18.

As is standard, a very wide strip of paper 19 from an unillustrated supply enters the machine underneath the traverse 5 and is passed through a slitter illustrated schematically at 40 to subdivide it transversely into at least two strips. The strips are pulled down from overhead and pass partially around the driven main roller 8 and then are wound up on the rolls 17 and 18. Once the roll 17 is finished, it is unloaded from the head 13 and moved out laterally to the position shown by full roll 20. When the roll 18 is similarly completed it is moved out in the opposite direction.

In order to reduce the noise generated by the machine, sound-damping assemblies 21 and 22 longitudinally flank the rolls 17 and 18. These assemblies 21 and 22 comprise vertically movable sound-absorbing curtains 23 and 24 which can be wound up about overhead rollers 25 and 26 and which slide in vertical side guides 29 and 30 that are of C-section to engage around the edges of the respective curtains 23 and 24. Each curtain 23 and 24 is at least 4 mm thick and can be comprised, for example of four 1 mm thick foils or three 2 mm thick foils. The use of several layers in each of the curtains 23 and 24 ensures that they remain fairly flexible and are easy to wind up and unwind.

The wind-up rollers 25 and 26 are held in overhead frames 27 and 28 mounted on the undersides of the transverse beams 6 and 7. These frames 27 and 28 extend transversely the full length of the machine above the respective rolls 17 and 18. The curtains 23 and 24 have horizontal lengths substantially greater than those of the rolls 17 and 18 and the edge guides 29 and 30 are spaced horizontally apart by a distance greater than the roll lengths so that these rolls 17 and 18 can easily be moved out between the guides 29 and 30 when the respective curtains 23 and 24 are raised. Similarly, when raised the lower edge of each curtain 23 and 24 is high enough to allow the respective roll 17 or 18 and the roll handling equipment to pass underneath. Furthermore the curtains 23 and 24 are made of transparent foils so workers can watch the machinery through them, without being subjected to the noise that is absorbed by them.

Noise at the longitudinal sides of the machine is damped by two more roller arrangements having wind-up rollers 31 and 32 shown open in the drawing. The unillustrated curtains of these rollers 31 and 32 travel in edge guides 33, 34, 35, and 36, the outer guides 33 and 34 being mounted right on the guides 29 and 30 to effectively close in the respective rolls 17 and 18. The inner guides 35 and 36 lie on the central support 3. They extend above the supports 9 and 10 so that same can move laterally out of the respective rolls 17 and 18 and into their parked positions during roll change. The unillustrated curtains of the rollers 31 and 32 are of the same construction as the curtains 23 and 24.

A PVC shield 37 is provided in the region between the inner edge guides 35 and 36 and the central support 3. In order to inhibit noise from escaping upwardly from the equipment, noise damping plates 38 and 39 are mounted on the frame 1 above the rolls 17 and 18.

We claim:

1. A paper-winding machine comprising:

a frame having longitudinal members and overhead transversely extending members connected between the longitudinal members;

a main roller supported in the frame and extending along and rotatable about a horizontal transverse axis below and between the transverse members;

a pair of take-up devices below the transverse members, defining winding stations, longitudinally flanking the main roller, and each having a roll and means for rotating the roll and thereby pulling a strip of paper from a supply and over the main roller to wind up on the respective roll until the respective roll has a predetermined large diameter;

sound-absorbing shields supported on the frame above the stations;

a pair of overhead wind-up rollers mounted on the transverse members and longitudinally flanking the rolls; and respective sound-absorbing curtains each formed of at least one flexible transparent synthetic-resin foil and each having an overall thickness of at least 4 mm on the wind-up rollers and movable from positions hanging down therefrom and absorbing sound generated at the stations and positions wound up on the respective wind-up rollers.

2. The improved paper-winding machine defined in claim 1 wherein each curtain is formed of at least two such foils.

3. The improved paper-winding machine defined in claim 1, further comprising:

upright edge guides, the curtain having edges received in the guides in the hanging-down position.

4. The improved paper-winding machine defined in claim 1, further comprising at least one second pair of overhead windup rollers separate from the first-mentioned pair, arranged generally perpendicular thereto, and flanking the rolls; and respective second sound-absorbing curtains of flexible sheet material on the second windup rollers and movable from positions hanging down therefrom and absorbing sound generated at the stations and positions wound UP on the respective rollers.

5. The improved paper-winding machine defined in claim 1 wherein each of the curtains is spaced from the respective roll by a distance smaller than the large diameter.

* * * * *